United States Patent [19]

Hill et al.

[11] Patent Number: 4,552,161

[45] Date of Patent: Nov. 12, 1985

[54] STICK ANTIPERSPIRANT PACKAGE AND PROCESS

[75] Inventors: John H. Hill, Edison; Luis S. Lisboa, Newark, both of N.J.

[73] Assignee: American Cyanamid Company, Stamford, Conn.

[21] Appl. No.: 532,876

[22] Filed: Sep. 16, 1983

[51] Int. Cl.[4] ..... A45D 40/30

[52] U.S. Cl. ..... 132/88.5

[58] Field of Search ..... 152/88.5, 88.7; 401/175–176, 171

[56] References Cited

U.S. PATENT DOCUMENTS

| | | | |
|---|---|---|---|
| 1,943,893 | 1/1934 | Johnson | 401/175 |
| 2,336,328 | 12/1943 | Whalen | 132/88.7 |
| 2,545,444 | 3/1951 | Braselton | 132/88.7 |
| 3,191,768 | 6/1965 | Davis | 401/175 X |
| 4,369,158 | 1/1983 | Woodruff | 401/175 |

FOREIGN PATENT DOCUMENTS

| | | | |
|---|---|---|---|
| 249473 | 10/1962 | Australia | 401/172 |

*Primary Examiner*—Gregory E. McNeill

*Attorney, Agent, or Firm*—Charles J. Fickey

[57] ABSTRACT

A package for wax-like cosmetic stick product having a twist-up in the bottom of the package, the twist-up comprising a base, spindle and elevator, vents in both said base and elevator, and a cap affixed to the package, wherein said package is filled through the bottom through an opening in the elevator.

7 Claims, 10 Drawing Figures

STICK ANTIPERSPIRANT PACKAGE AND PROCESS

This invention relates to a method for the manufacture of a solid, low melting, wax-like cosmetic or pharmaceutical stick in a twist-up type package. More particularly, it relates to an improved method for increasing the bonding strength between a plastic twist-up and the solid or semi-solid stick composition.

Most cosmetic sticks, including deodorant and antiperspirant compositions, comprise a solid, waxy formulation containing an active ingredient, where applicable, encased in a suitable container provided with a means for pushing the stick upwards through the container to expose more surface as the stick is consumed. Heretofore, as far as we are aware, these sticks, particularly deodorant and antiperspirant sticks, have been fabricated by pouring the molten composition into the top of a suitable container equipped with a suitable twist-up device inserted into the bottom thereof. In so doing, a pouring cup, open at the top, or pouring device, may first be attached to the top of the container in a removable manner, or filling may be without a pouring clip.

The method described results in a product having a number of disadvantages. A top surface is formed on the stick which is substantially perpendicular to the longitudinal axis of the stick, thereby forming a squared edge. With some formulations, when this edge is applied to a surface, it results in crumbling, with resultant loss of material until a rounded edge finally forms. In addition, during cooling and solidification of the stick material is poured in the container, the top surface contracts leaving air voids creating an unfavorable effect esthetically in the mind of the user.

It has also been proposed to form such a cosmetic stick by a process in which the container is first fitted with a pouring cap, inverted and filled with the molten material through the open bottom of the container. Before the molten material is cooled, a twist-up device was inserted through the bottom of the container to contact the base of the solid cosmetic stick, the pouring cap was removed, and a regular package cap fitted to the container. Although this process formed a uniform shaped top to the cosmetic stick, it did not produce a firm bond between the base of the stick and the twist-up. The result was that the stick often separated from the twist-up and fell out of the container. In addition, large voids or shrink holes were formed in the base of the stick and depressions formed on the outer surface of the stick.

The present invention is an improvement over the prior process, whereby the bond strength between the push-up and the stick composition is improved; the shrink hole and air bubble formation are reduced; better control on the insertion of the housing component to be bonded with the stick is obtained; better control of the state of the stick prior to and during insertion is obtained; there is increased manufacturing speed; and minimization of the effects of line breakdowns and variability of product are achieved.

The invention may be better understood by reference to the drawings in which.

Figure 10:
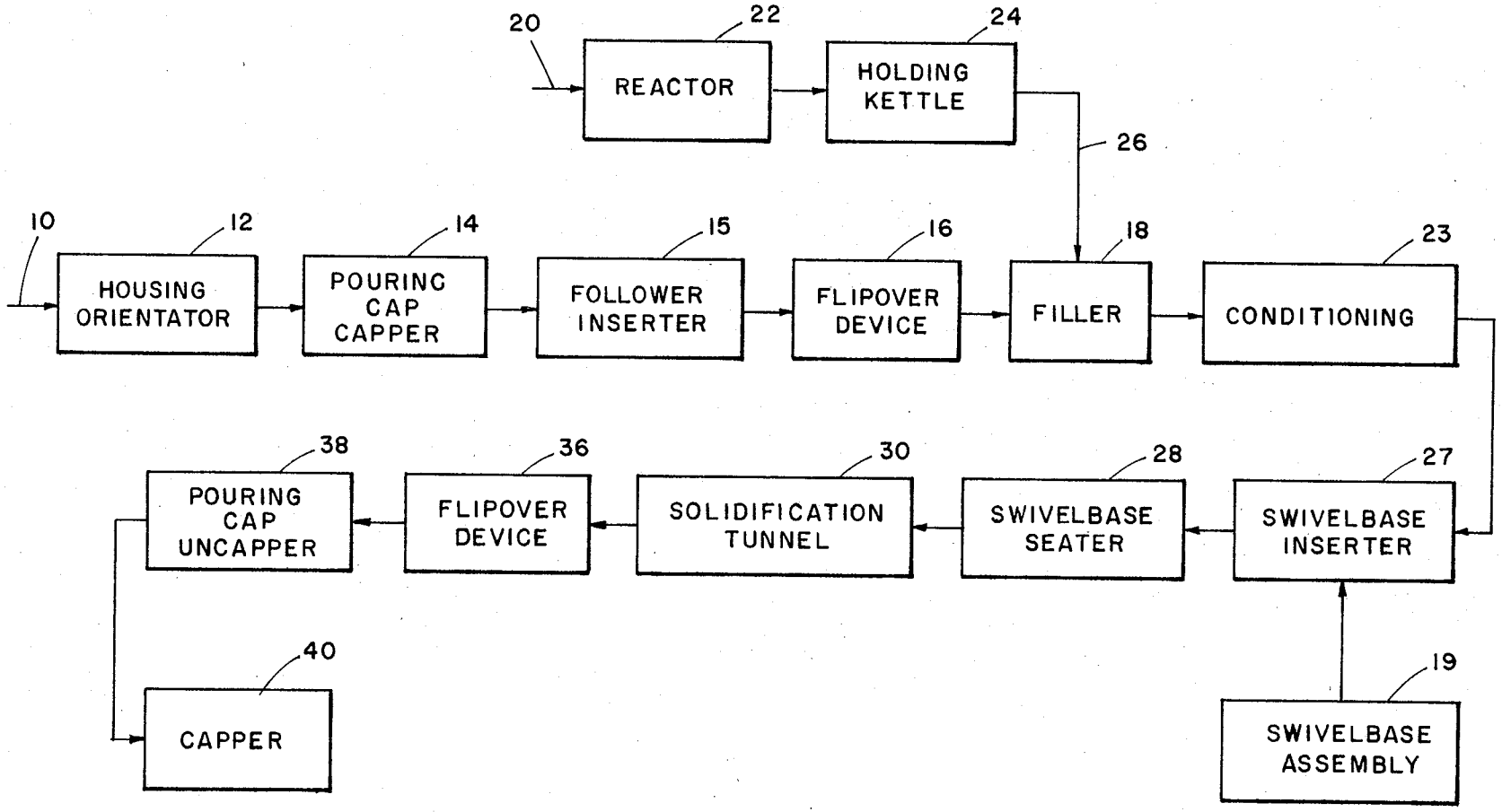
FIG. 10 is a flow diagram of the process of the invention.

With reference to the flow sheet of FIG. 10, a reactor 22 is charged via line 20 with the ingredients to prepare a cosmetic stick formulation, such as an antiperspirant, which is then held until needed in a heated holding kettle 24.

Figure 1:
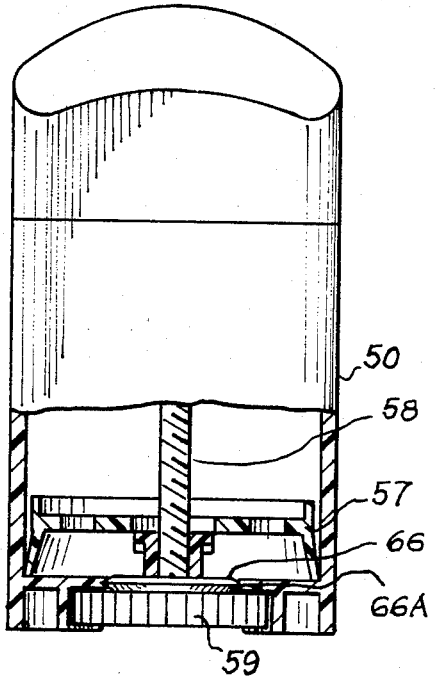
FIG. 1 is a front elevational view of the package and cap with parts broken away to show the twist-up and elevator in place.

In a continuous manner a housing orientator 12 aligns the container bodies or housings 50 (see FIGS. 1 and 4) which are generally open at the top 51, with a bottom opening 52 in the base 53, in an upright position on a conveyor belt 10. Container 50 then has follower 57 inserted at 15 and positioned at the bottom of container 50, where it is held in position by tabs 56 provided on the inner, surface of housing 50. Tabs 56 should be large enough to hold follower 57 during pouring of molten stick material and insertion of the twist-up spindle, as later described. However, tabs 56 must not prevent movement of the follower where the spindle is rotated. After insertion of follower 57, container housing 50 moves to a pouring cap affixing or capping device 14 which affixes onto the top of the housing a pouring cap 54, which closes the top end of the container housing. The interior surface of pouring cap 54 is shaped to form a custom upper surface of the stick. A premeasured quantity of the molten formulation from holding kettle 24 at a temperature of about 53° C. is then added to container 50 through the bottom opening 52 by filling device 18 via line 26.

After the required amount of molten material has been filled in housing 50, housing 50 enters a conditioning tunnel 23, for conditioning the molten material. In conditioning tunnel 23, the molten material is first cooled until it is solid. The cooling temperature may vary, but the cooling should be cold enough and of such duration that the molten material is solidified, e.g. 0° to 45° C. for a time of 5 to 30 minutes. During solidification a hole or void forms at the center of the upper surface of the fill material. This is undesirable since it adversely affects the adhesion of the solidification molten stick material to spindle 58 and follower 57 and provides a weak area where the stick could crumble. Therefore, conditioning tunnel 23 then provides a remelt stage where the upper surface of the solidification fill material is remelted to the liquid state, e.g. by infra red lamps, usually to a depth of horizontal surface 65A of follower 57.

Figure 2:
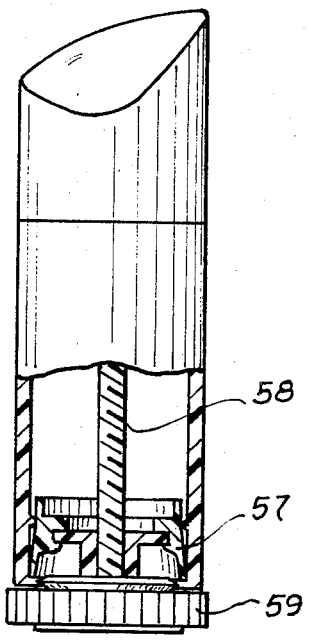
FIG. 2 is a side view of the container of FIG. 1 with a twist-up assembly inserted.
Figure 3:
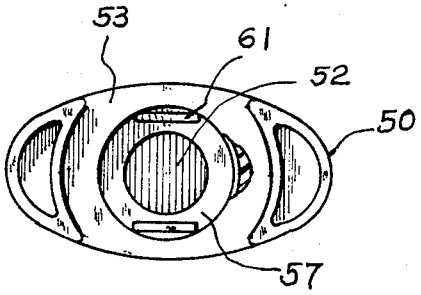
FIG. 3 is a bottom view in elevation of container of FIG. 1 with the twist-up spindle removed.

After the remelt stage and while the upper surface of the fill material is still liquified, twist-up assembly 55 preassembled at 19 (see FIG. 10) is inserted into housing 50 (see FIG. 2) by inserter 27 while the fill material is still molten. Twist-up assembly 55 consists of spindle 58 with knob 59 and latch collar 60. Spindle 58 fits through opening 52 of the bottom of housing 50 and is held in place by flanges 61 of collar 60 by yieldable tabs 61A which form grooves 62 in the lower part of follower 57. Latch collar 60 has a threaded central opening 63 which fits onto threaded spindle 58. Elevator 57 has ventilation openings 64 and 65 respectively if necessary for passage of air. This is necessary so that the trapped air may escape from case 50 when the twist-up assembly is inserted, to prevent formation of voids in the fill material after solidification.

Spindle assembly 55 is inserted slowly at a controlled rate at low pressure by seater 29 to prevent splashing of molten material, and sealing of vent holes 64 and 65 in follower 57 and prevent proper circulation of air. Housing 50 has an annular groove 66 in the base into which an annular snap lock 66A of spindle 58 locks, to hold the twist-up assembly 55 in case 50. Container 50 then traverses a solidification zone or tunnel 30 whereby it is cooled and solidifies to form the stick product. The temperature of tunnel 30 is 0° to 45° C. for a residence time of 5 to 30 minutes.

Figure 4:
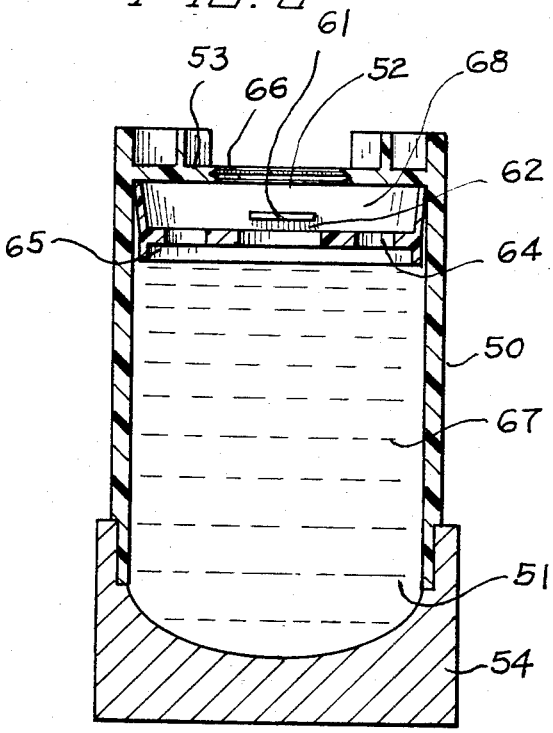
FIG. 4 is a front cross-sectional view of the container and elevator in inverted position with pouring mold, after pouring product.
Figure 5:
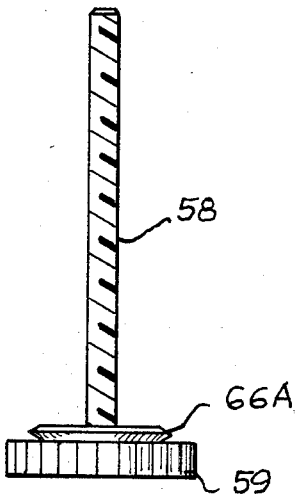
FIG. 5 is an elevational view of the spindle.
Figure 6:
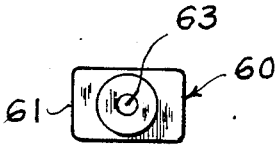
FIGS. 6 and 7 are respectively bottom and elevational views of the spindle latch collar.
Figure 7:
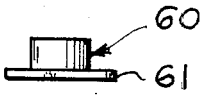
Figure 8:
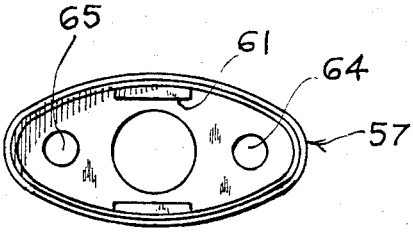
FIGS. 8 and 9 are respectively bottom and cross-sectional views of the elevator of the container.
Figure 9:
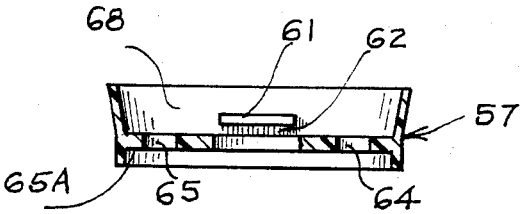

Solidification tunnel 30 may provide a staged cooling, by providing progressively cooler zones until room temperature is reached. The time in solidification is sufficient for the molten material to solidify to form a stick 67 as shown at FIG. 4, and for removal of pouring cap 54 without tearing off part of the stick. Moreover, if it is found that large shrink holes develope around spindle 58, a staged cooling should be used. In staged cooling, the first stage can be for 10 minutes at 45° C., the second stage for 10 minutes at 25° C., and the third stage for 10 minutes at 10° C. It will be realized that these stages may be varied in accordance with the formulation of the product. After solidification, container 50 is then inverted by a flip-flop device 36 and then travels to an uncapping device 38 which removes pouring cap 54 from the top of container 50. Finally, the container is capped by the capper device 40.

The shape of the top surface of the stick will depend on the design of the mold inserted into the pouring cap. Such designs may include lettering etched into the mold surface to depict the product name or company logo, and the like. Moreover, the mold may provide a tapered edge to the top edge of the stick whereby crumbling of the stick is prevented during use.

The container package of the invention is particularly useful for the preparation of deodorant and antiperspirant sticks, but may be used for other cosmetic, pharamaceutical or other wax-like formulations in stick form.

The comparison of processes and packages is summarized in Table I. The present process and package is compared to that of U.S. Pat. No. 4,369,158, and also to the process and package for forming a cylindrical stick with a push-up follower.

The formulation used for all comparative tests was identical and had the following composition:

| | Parts by Weight |
|---|---|
| Ethoxylated Stearyl Alcohol | 1.0 |
| Stearyl Alcohol (95%) | 20.0 |
| Aluminum Chlorhydrate | 25.0 |
| Cyclic Silicone Pentamer | 53.4 |
| Fragrance | 0.6 |
| | 100.0 |

The bond strength is greatly increased and the void space is reduced by the use of the present package, and process as shown in Table I.

TABLE I

| Process Time | Hole Size ($cm^3$) | % Change | Bond Strength (g) | % Change |
|---|---|---|---|---|
| U.S. Pat. No. 4,369,158 Process, 32 Minutes total | 0.75 | — | 205 | — |
| Push-Up Cylindrical Stick Process, 15 minutes total | 0.31 | — | 670 | — |
| Fill-Thru Follower 35° C. Conditioning (15 min.) 25° C. Cooling (15 min.) 32 minutes total | 0.55 | −26.7% | 203 | − 1.0% |
| Fill-Thru Follower 35° C. Conditioning (15 min.) heat lamps, 35° C. Cooling (3 min.), 20 minutes total | 0.09 | −88.0% | 325 | +58.5% |
| Fill-Thru Follower 0° C. Cooling (10 min.) heat lamps, 25° C. Cooling (3 min.), 15 minutes total | 0.11 | −85.3% | 357 | +74.6% |

A greater than 80% reduction in hole size is possible when the fill-thru-baseplate design is coupled with heat lamp conditioning of the product. This conditioning effectively remelts the exposed upper surface of the stick, thus filling in the forming shrink hole. This conditioning approach is not possible with the package of U.S. Pat. No. 4,369,158 and process because the elevator, spindle and baseplate are inserted immediately after fill in the molten material. Component insertion, in this case, must be immediate to maximize the bonding of the product to the elevator. Delayed insertion, even when coupled with a remelt operation, results in a 90% to 100% incidence of unbonded product. The present process results in an average internal void of 0.75 $cm^3$. Values of 0.09 $cm^3$ and 0.11 $cm^3$ were attained when fill-thru follower package of the present invention was coupled with a remelt process.

In addition, a greater than 50% increase in bond strength was achieved in tests coupling the fill-thru follower design with heat lamp remelt procedures. In addition, top insertion instead of bottom insertion of the follower will enable us to redesign this component to improve stick retractability. The follower of U.S. Pat. No. 4,369,158 exhibits poorer retractability which is attributable to its design. Sticks produced by the present process had an average bond strength of 205 g. Average values greater than 300 g were attained during several pilot scale tests of this conception.

The process time for U.S. Pat. No. 4,369,158 from point of fill to pack-out is 32 minutes. This includes the 15 minures of 35° C. product conditioning and 15 minutes subsequent room temperature cooling required prior to pour cap removal. The combination of 0° C. conditioning with heat lamp treatment in the present process demonstrated the potential to decrease this process time to 15 minutes, a 50% reduction. This would allow for increased filling line rates and easier coordination of production workers during start up breaks and at the end of a shift. For example, at a fill rate of 100 pieces/min, production output would be increased by 500 k pieces per year. Increased production line rates were achieved on the cylindrical stick production line by filling through the push-up, and using conditioning and staged cooling. The 15 minute process according to the present invention resulted in a small internal void, 0.11 $cm^3$, and a good bond 357 g.

Bottom filling in the package of the invention also compensates for uneven filling. Thus it is not necessary to have as precise measuring of the quantity since the cavity 68 below elevator 57 will allow for excess molten stick material.

The present process and package make it possible to produce a stick which is homogeneous, virtually free of voids, dimples and has improved bonding to the elevator in a twist-up, non-symetrical package, and further in shorter process time.

We claim:

1. A twist-up type container intended to hold and dispense a solid, wax-like stick product; said container comprising in combination a housing for said proudct, a following, and a threaded spindle having a latch collar threaded thereon; said housing being open at the top and closed at the base except for an opening substantially at the center of said base, said base opening being sufficiently large for said latch collar to pass through, said follower being positioned in said housing and having an opening substantially at the center thereof larger than said threaded spindle and in substantial registration with said base opening; said follower further having means to lock it to said latch collar when said spindle is inserted into said housing through said basing opening thereof; said spindle further having means to lock it rotatably in said base opening; whereby said container may be filled with molten product through said base opening and elevator opening, and said spindle maybe inserted and locked to said follower after said container is filled, after which said molten product solidifies in said housing.

2. The combination of claim 1 wherein said spindle means comprises a threaded spindle, a threaded sleeve on said spindle, and a knob at the base of said spindle for turning said spindle, said knob having an annular ridged flange on its upper surface, said container having an annular groove in the base thereof adapted to receive said ridged flange; said follower has grooves below the baseplate thereof, and said threaded sleeve is adapted to lock into said grooves in said follwer.

3. The combination of claim 1 wherein said spindle has means to prevent said threaded sleeve from being moved off the upper end of said spindle.

4. The container of claim 1 wherein said means to lock said spindle means to said follower comprises a threaded sleeve fitting on said spindle, said sleeve and said follower having mutually engagable locking means.

5. The container of claim 1 wherein said follower has at least one air vent through the base thereof.

6. The combination of claim 2 wherein said container has means to hold said follower against the inner surface of the bottom of the container.

7. The combination of claim 6 wherein said means are ridges on the inner surface of the container adapted to hold said follower against the force of locking said threaded sleeve to said follower, but to allow said follower to be raised by rotation of said spindle.

* * * * *